United States Patent [19]

Black et al.

[11] Patent Number: 4,692,947

[45] Date of Patent: Sep. 15, 1987

[54] PROTECTIVE HELMET, CHIN CUP, AND FACE GUARD

[76] Inventors: Randy D. Black, 532 Smith Rd., Knoxville, Tenn. 37922; Walter F. Tomczak, 7450 Fairway Rd., Leesburg, Fla. 32788

[21] Appl. No.: 792,002

[22] Filed: Oct. 28, 1985

[51] Int. Cl.[4] ..... A42B 3/00

[52] U.S. Cl. ..... 2/421; 2/9; 2/424; 2/425

[58] Field of Search ..... 2/421, 425, 9, 10, 6, 2/424, 410

[56] References Cited

U.S. PATENT DOCUMENTS

| | | | |
|---|---|---|---|
| 2,769,176 | 11/1956 | Grancsay et al. | 2/421 |
| 3,106,716 | 10/1963 | Beebe | 2/9 |
| 3,166,761 | 1/1965 | Strohm | 2/9 X |
| 4,044,400 | 8/1977 | Lewicki et al. | 2/421 |
| 4,051,556 | 10/1977 | Davenport et al. | 2/421 |
| 4,086,664 | 5/1978 | Humphrey et al. | 2/9 |
| 4,398,306 | 8/1983 | Gooding | 2/421 |

FOREIGN PATENT DOCUMENTS

| | | | |
|---|---|---|---|
| 0077015 | 4/1983 | European Pat. Off. | 2/421 |
| 1354719 | 5/1974 | United Kingdom | 2/421 |

*Primary Examiner*—Peter Nerbun

*Attorney, Agent, or Firm*—Powell L. Sprunger

[57] ABSTRACT

A protective headgear comprising, a shell for receiving a wearer's head, and a cup to receive the wearer's chin. The headgear has a strap connecting the cup to the shell, with the strap having a first strap segment with one end fixedly attached to the shell and extending to the cup, and a second strap segment having one end releasably attached to the shell and extending to the cup.

10 Claims, 4 Drawing Figures

FIG. 1
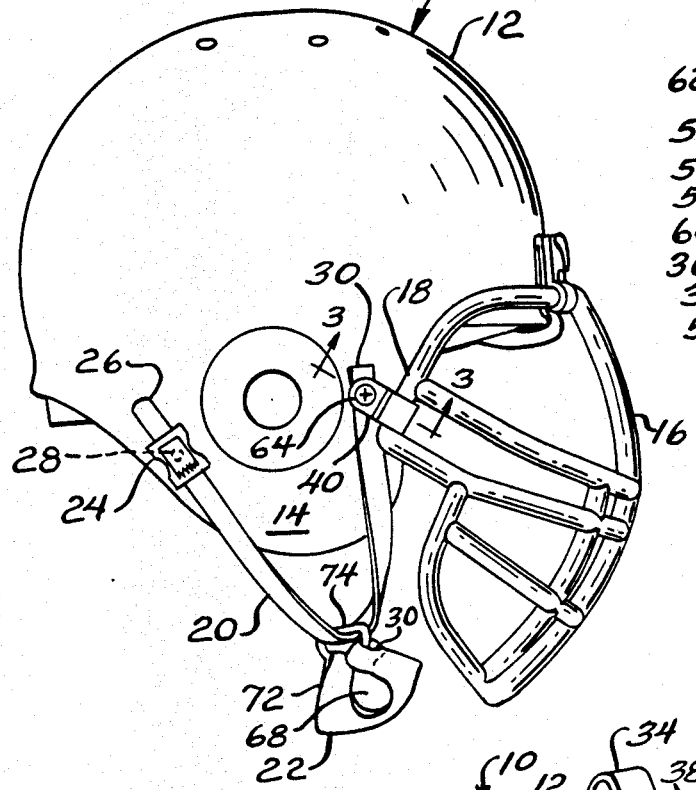
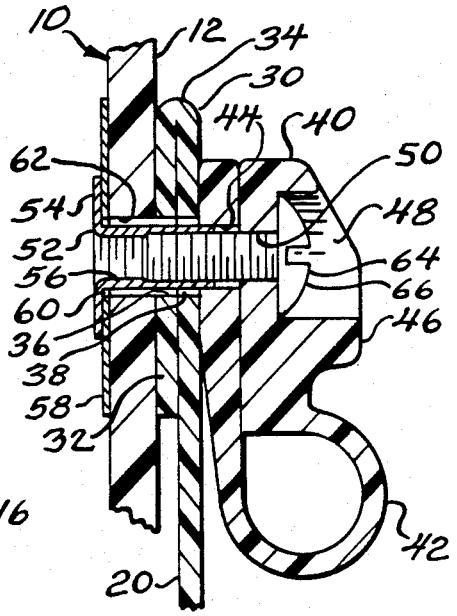
FIG. 3
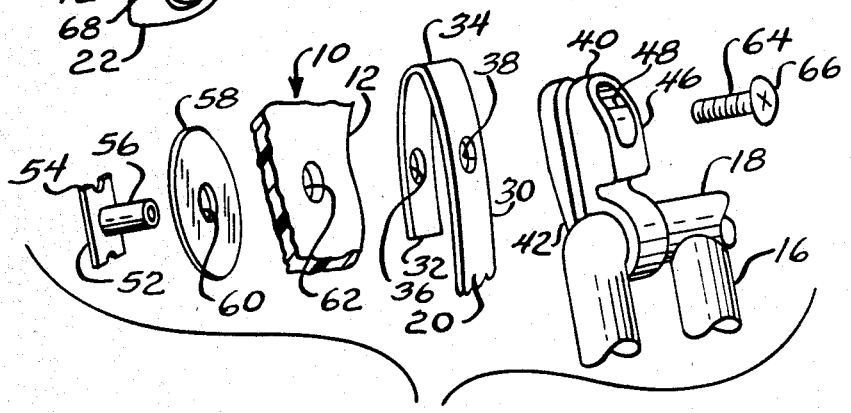
FIG. 2
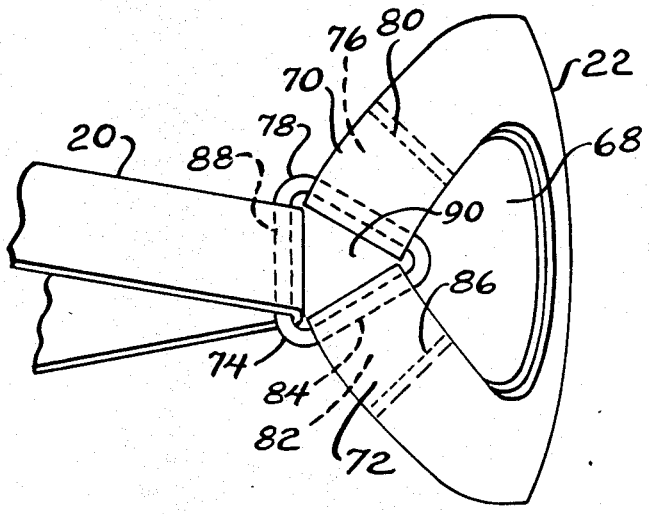
FIG. 4

PROTECTIVE HELMET, CHIN CUP, AND FACE GUARD

BACKGROUND OF THE INVENTION

The present invention relates to protective headgear.

A variety of protective headgear, such as football helmets, are known. Such headgear normally have a rigid shell to receive the wearer's head, a face mask to protect the wearer's face, and a cup to receive the wearer's chin and hold the shell in place on the head. Normally, the cup is releasably attached to the shell by both of a pair of straps on each side of the cup and shell. Ends of the straps are received in snap fasteners which require tedious adjustment in both fasteners to locate the cup on the wearer's chin. Hence, it is desirable to facilitate adjustment of the cup to the wearer's chin. Further, the cups and straps become frequently misplaced, since they are releasably attached to the shell.

SUMMARY OF THE INVENTION

A principal feature of the present invention is the provision of an improved protective headgear.

The headgear of the present invention comprises, a shell for receiving a wearer's head, and a cup to receive the wearer's chin. The headgear has strap means connecting the cup to the shell, with the strap means having a first strap segment with one end fixedly attached to the shell and extending to the cup, and a second strap segment having one end releasably attached to the shell and extending to the cup.

A feature of the present invention is that the strap means is thus fixedly attached to the shell, which prevents loss of the cup during use of the headgear.

Another feature of the present invention is that the strap means has improved retention to the shell during use of the headgear.

A further feature of the present invention is that the strap means is more easily re-attached to the shell than prior devices.

Yet another feature of the present invention is that the strap means reduces visual obstructions during use of the headgear.

Still another feature of the present invention is that the strap segment may be attached to the shell with a retaining member for securing a face mask to the shell.

Accordingly, a feature of the present invention is that the strap means may be fixedly attached to the shell without additional components.

Another feature of the invention is that the strap means and cup provide additional shock absorbency to the side mounts of the face mask where breakage most often occurs.

Still another feature of the invention is that the strap means is interchangeable with pre-existing shells currently in the field for use.

A feature of the present invention is that the strap means is slidably received in the cup adjacent its ends.

Thus, another feature of the invention is that the cup and strap means facilitates adjustment of the cup on the wearer's chin.

A further feature of the invention is that the strap means facilitates manufacture of the headgear, such as by eliminating additional openings in the shell, and eliminating chin strap studs.

Further features will become more fully apparent in the following description of the embodiments of this invention and from the appended claims.

DESCRIPTION OF THE DRAWINGS

In the drawings:

FIG. 1 is an elevational view of a protective headgear of the present invention;

FIG. 2 is an exploded view of an assembly for fixedly securing an end of a chin strap to a shell of the headgear;

FIG. 3 is a fragmentary sectional view taken substantially along the line 3—3 of FIG. 1; and FIG. 4 is a fragmentary elevational view taken on a large scale of a chin strap and cup for the headgear of FIG. 1.

DESCRIPTION OF THE PREFERRED EMBODIMENTS

Referring now to FIG. 1, there is shown a protective headgear generally designated 10 having a hollow rigid shell 12 to receive a wearer's head. The shell 12 has a pair of lower ear protectors 14 to protect the wearer's ears during use of the shell 12. As shown, the headgear 10 has a face mask 16 to protect the wearer's face during use of the headgear 10, with the face mask 16 having a bar 18 defining a side portion of the face mask 16. The headgear 10 has an elongated integral strap 20, and a cup 22 connected to the strap 20 to receive the wearer's chin and hold the shell 12 in place on the wearer's head during use.

The headgear has a fastener 24 of known type adjustably received on one end 26 of the strap 20. The shell 12 has a stud 28 on one side of the ear protector 14 in order to releasably attach the fastener 24 to the stud 28.

The strap 20 has a second end 30 which is fixedly attached to the shell 12 adjacent the other side of the ear protector 14 in a manner as described below. The second end 30 of the strap 20 has an end segment 32 which is folded back along a fold line 34, with the end segment 32 and adjacent portion of the strap 20 having a pair of aligned apertures 36 and 38.

The headgear 10 has a retaining member 40 to secure the bar 18 on the side portion of the face mask 16 to the shell 12, in addition to fixedly attaching the second end 30 of the strap 20 to the shell 12. The retaining member 40 has an inner strap 42 which extends around the bar 18, and has an opening 44 aligned with the apertures 36 and 38 of the strap 20. The retaining member 40 has an enlarged end portion 46 having a recess 48 communicating with an opening 50 extending through the end portion 46, with the openings 44 and 50 of the retaining member 40 being aligned.

The headgear 10 has inner nut means 52 with an outwardly directed flange 54 located on an inside of the shell 12, and an outwardly directed threaded cylinder 56 attached to the flange 54. The headgear 10 also has a washer 58 having a central aperture 60, such that the washer 58 is received on the cylinder 56. Also, the shell has an aperture 62 extending through the shell 12 in order to receive the cylinder 56 of the nut means 52 with the washer 58 in place on the threaded cylinder 56. In this configuration, the cylinder 56 of the nut means 52 extends through the aperture 62 of the shell 12 and the apertures 36 and 38 of the strap 20.

The headgear 10 also has a threaded screw 64 having a head 66. As shown, the screw 64 is received in the opening 50 of the retaining member 40 with the head 66 of the screw 64 being received in the recess 48 of the retaining member 40. The screw 64 is threadedly received in the cylinder 56 of the nut means 52 with the screw 64 also extending through the opening 44 of the strap 42 of the retaining member 40. In this manner, the retaining member 40 and strap 20 are fixedly secured to the shell 12 through use of the screw 64 and nut means 52. Thus, the second end 30 of the strap 20 is fixedly secured to the shell 12 through use of the securement device for the retaining member 40 which retains the bar 18 of the face mask 16 to the shell 12.

The cup 22 has a cut-out 68 extending from an end of the cup 22 to define a pair of end segments 70 and 72 of the cup 22. The assembly has a triangular-shaped metal retaining member 74. One end 76 of the end segment 70 is looped about one side 78 of the retaining member 74, and is secured in place, such as by a line of sewing 80. One end 82 of the other end segment 72 is looped about a second side 84 of the retaining member 74, and is secured in place, such as by a line 86 of sewing. In this manner, the end segments 70 and 72 are secured to the retaining member 74, and are gathered together adjacent the end of the cup 22 by the retaining member 74.

The remaining third side 88 of the retaining member 74 defines an opening 90 to slidably receive a central portion of the strap 20.

Of course, the other side of the cup 20 is attached by another strap (not shown) in a manner as above described in connection with the strap 20. Accordingly, the cup 22 is adjustably mounted on the strap 20 by sliding movement through the retaining member 74 in order to adjustably position the cup 22 on the wearer's chin without requiring tedious adjustment of fasteners which are attached to the shell.

The foregoing detailed description is given for clearness of understanding only, and no unnecessary limitations should be understood therefrom, as modifications will be obvious to those skilled in the art.

I claim:

1. A protective headgear, comprising:

a shell for receiving a wearer's head, and having opposed sides;

a cup to receive the wearer's chin; and strap means connecting the cup to the shell, said strap means having a first strap segment with one end fixedly attached to one side of the shell and extending to the cup, and a second strap segment having one end releasably attached to the same side of the shell and extending to the cup, including means for securing a face guard to the shell, and in which the one end of the first strap segment is attached intermediate the securing means and the shell.

2. The headgear of claim 1 wherein the shell includes an aperture underlying the one end of the first strap segment, the one end of the first strap segment includes an aperture aligned with the shell aperture, and including nut means having an outwardly directed flange disposed inside the shell and a threaded cylinder extending from the flange and disposed in the shell aperture, and a threaded screw extending through the strap aperture and received in the threaded cylinder.

3. The headgear of claim 2 including a washer having an aperture received on the cylinder intermediate the flange and shell.

4. The headgear of claim 2 wherein the one end of the first strap member is folded about a fold line with an end segment being aligned with an adjacent portion of the strap segment, with an aperture being located in the end segment and adjacent portion of the strap member, and with the strap member apertures being aligned to receive the screw.

5. The headgear of claim 2 including a retaining member for securing a face mask to the shell, said retaining member having an inner strap having an opening aligned with the aperture of the strap member to receive the screw, said strap extending around a bar of the face mask and terminating in an enlarged end portion having an opening aligned with the strap opening to receive the screw.

6. The headgear of claim 5 wherein the end portion of the retaining member has a recess communicating with the end portion opening to receive a head of the screw.

7. A chin cup for a protective headgear, comprising:

a cup portion of flexible material having a central longitudinally extending cut-out in an end portion of the cup portion defining a pair of spaced end segments of the cup portion; and a retaining member extending through the end segments and defining an opening adjacent the end segments to slidably receive a strap, said end segments being free of direct attachment with each other.

8. The cup of claim 7 wherein the retaining member has a triangular shape with one side of the retaining member being received in one end segment of the cup portion, with another side of the retaining member being received in the other end segment of the cup portion, and with the remaining side of the retaining member defining the opening to receive the strap, said retaining member pulling the end segments of the cup portion toward each other.

9. The cup of claim 8 wherein the end segments are looped about the sides of the retaining member.

10. A protective headgear, comprising:

a shell for receiving a wearer's head, and having opposed sides;

a cup to receive the wearer's chin; and strap means connecting the cup to the shell, said strap means having a first strap segment with one end fixedly attached to one side of the shell and extending to the cup, and a second strap segment having one end releasably attached to the same side of the shell and extending to the cup, wherein the shell includes an aperture underlying the one end of the first strap segment, the one end of the first strap segment includes an aperture aligned with the shell aperture, and including nut means having an outwardly directed flange disposed inside the shell and a threaded cylinder extending from the flange and disposed in the shell aperture, and a threaded screw extending through the strap aperture and received in the threaded cylinder.

* * * * *